US005141104A

United States Patent [19]

Morrow et al.

[11] Patent Number: 5,141,104

[45] Date of Patent: Aug. 25, 1992

[54] HANGER FOR DISPLAYING EYEGLASSES

[75] Inventors: Lester Morrow, Ossining; Leon Chang, Fresh Meadows, both of N.Y.

[73] Assignee: VSI International Inc., Fort Lauderdale, Fla.

[21] Appl. No.: 719,815

[22] Filed: Jun. 24, 1991

[51] Int. Cl.[5] ..... B65D 73/00; B65D 85/18; A47F 7/02

[52] U.S. Cl. ..... 206/5; 206/486; 206/806; 211/59.1; 351/158

[58] Field of Search ..... 2/13; 206/5, 6, 478, 206/482, 486, 488, 489, 806; 211/13, 59.1; 223/85; 351/41, 158

[56] References Cited

U.S. PATENT DOCUMENTS

| | | | |
|---|---|---|---|
| 2,106,615 | 4/1936 | Maurer . | |
| 2,656,918 | 10/1953 | Hollis | 206/482 |
| 2,764,286 | 9/1956 | Carmichael | 206/486 |
| 3,184,058 | 5/1965 | Crowther | 206/5 |
| 3,299,439 | 1/1967 | Bohner . | |
| 3,381,806 | 5/1968 | McDonagh . | |
| 3,858,726 | 1/1975 | Rosenwein . | |
| 4,944,389 | 7/1990 | Robertson | 206/486 |
| 4,976,532 | 12/1990 | Nyman . | |

*Primary Examiner*—Jimmy G. Foster

[57] ABSTRACT

A hanger for supporting a pair of eyeglasses. The hanger has a central portion, two arms which extend away from the central portion and which terminate at end portions. Each end portion has a respective opening into which is inserted a respective temple bar of the pair of eyeglasses. The central portion has an aperture into which is inserted a support arm for balancing the eyeglasses. The aperture is substantially equidistant from the openings in the end portions. The arms have a lower edge which defines a space directly between the end portions.

29 Claims, 2 Drawing Sheets

HANGER FOR DISPLAYING EYEGLASSES

BACKGROUND OF THE INVENTION

The present invention relates to a hanger which is removably secured to and supports a pair of eyeglasses for purposes of display.

U.S. Pat. No. 4,976,532, whose contents are incorporated by reference, discloses a hanger for displaying a pair of non-prescription eyeglasses. Typically, the eyeglasses are selected by a customer without the assistance of a sales person. The hanger need not be removed from its securement to the eyeglasses in order for the customer to try on the eyeglasses.

The hanger includes a relatively stiff resilient plastic element which has a main section with an aperture for receiving insertion of a support arm therethrough. The hanger also has a relatively narrow extension which passes through the nose gap of the eyeglasses and is reversely bent to form a loop that surrounds the eyeglass frame bridge. The loop is held closed by a metal rivet or snap-type closure to prevent casual removal of the hanger from the eyeglasses.

Such a hanger is made of two pieces, i.e., the plastic element and the metal rivet or snap-type closure. It might be desirable to simplify the manufacture of the hanger by replacing the two-piece construction by a single piece construction and yet still prevent casual removal of the hanger from the eyeglasses.

A customer may try on the eyeglasses without having to remove the hanger. However, the narrow extension, which loops around the eyeglass frame bridge, comes into contact with the nose of the wearer. It would be preferable, therefore, for the customer to be able to try on the eyeglasses and find out how the eyeglasses will actually feel even when the hanger is attached to the eyeglass. In other words, it would be preferable if the hanger did not contact the face of the customer in those areas where the eyeglass frame will rest on the face of the customer in normal use.

In addition, it would be preferable if no portion of the hanger extended in front of the eyeglasses. Thus, a customer looking at a mirror when trying on the eyeglasses would thereby obtain an unobstructed view of the eyeglasses including the bridge thereof, to see how the eyeglasses will look when they are positioned on the face.

It would be further desirable to avoid covering the bridge of the eyeglass with the hanger while the eyeglasses are hanging from a display so that the customer, when making a selection, will have a true sense of the look of the eyeglass without any portion being hidden from view.

SUMMARY OF THE INVENTION

The present invention is directed to a hanger for a pair of eyeglasses. The hanger is a one-piece construction whose ends each have a respective aperture, through which is inserted a respective one of two temple bars of the pair of eyeglasses until the hanger is positioned approximately adjacent the temple/frame pivot lugs, which are to the side of the eyeglasses themselves. According to a preferred embodiment, each aperture is constituted by a circular opening which is in communication with a plurality of pairs of diametrically oppositely extending resilient slits that extend radially outward from the circular opening. These slits facilitate insertion of the temple bars through the circular opening even where the ends of the temple bars are wider than the circular opening.

The hanger has a central portion which extends between the ends at an elevation higher than that of the ends. Preferably, this central portion extends above the eyeglasses themselves when the apertures in the ends are in position on the temple bars. The central portion has an aperture for receiving insertion of a support arm of the display therethrough. Such an aperture is preferably located substantially equidistant from the ends of the hanger so that the eyeglasses will be balanced from the hanger in a hanging position relative to the support arm.

DESCRIPTION OF THE PREFERRED EMBODIMENT

Figure 1:
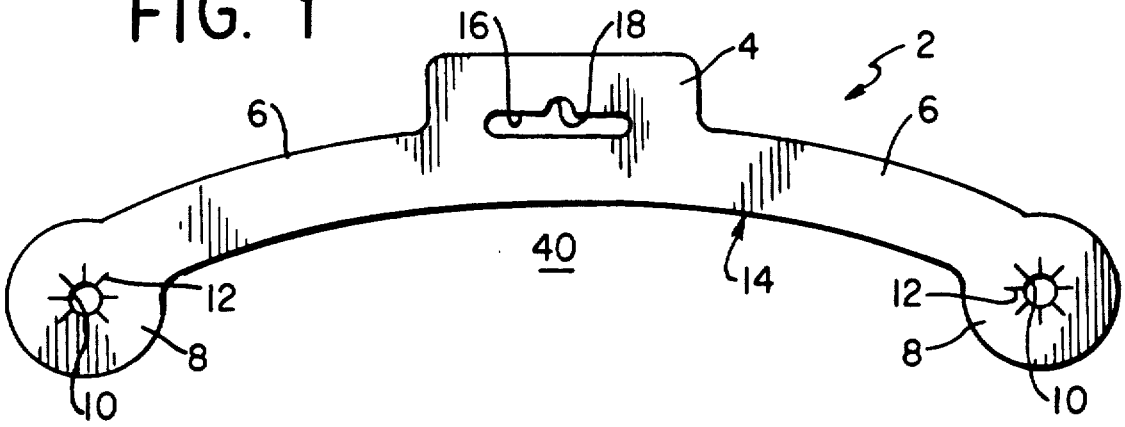
FIGS. 1, 2 and 3 are respective front elevation views of the hanger in accordance with a first, a second and a third embodiment of the invention, respectively.
Figure 2:
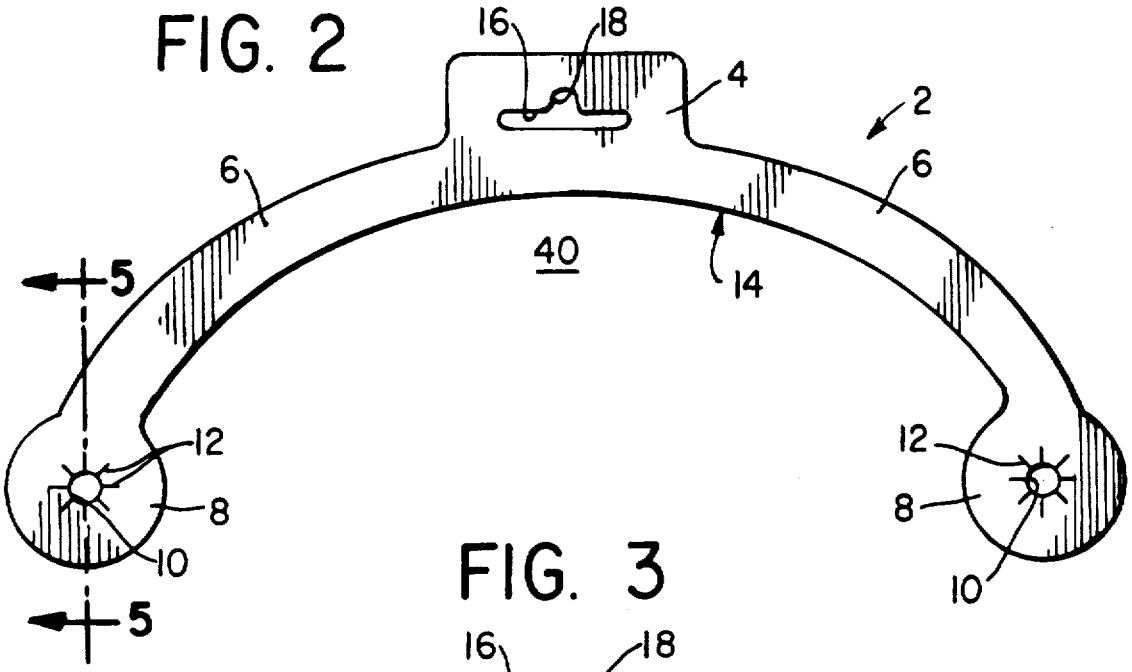
Figure 3:
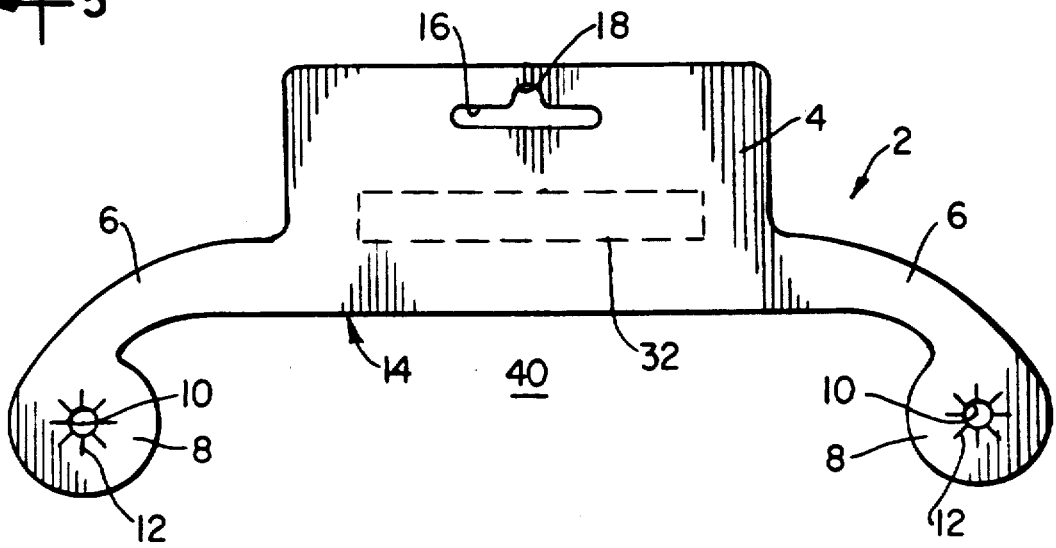

FIGS. 1-3 each show a hanger 2 made from a substantially flat planar, thin, flexibly resilient, transparent and plastic material such as vinyl or acrylic polyester. Preferably, the shape of the hanger is cut from a sheet of such material of approximately 1/32" thickness. All corners are rounded to eliminate sharp edges. The hanger 2 may be flexibly resilient in a direction outside the plane of the hanger, but is relatively stiff and unyielding in the plane of the hanger. Thus, the hanger resists deformation in the planar direction from hanging objects such as a pair of eyeglasses secured thereto.

The hanger 2 has a central portion 4 and has two arms 6 which extend in opposite directions from the central portion 4 and which terminate at respective end portions 8. Each end portion 8 has a respective circular opening 10 through which may be inserted temple bars of a pair of eyeglasses. A plurality of diametrically oppositely extending slits 12 are in communication with a respective opening 10 and extend radially outward therefrom. The end portions 8 and openings 10 each may have a generally circular shape as shown, but may have instead any other shape such as a slit.

Even if the ends of the temple bars are wider than the diameter of the circular opening 10, they may be fit through the larger opening afforded by the slits 12, because the hanger material is sufficiently flexibly resilient to bend to accommodate. Thus, the portion of this flexibly resilient material which is between the slits may freely bend resiliently in a direction out of the plane of the flat planar face of the hanger so as to enlarge the opening and accommodate insertion of the temple bars through the circular opening 10.

FIGS. 1-3 each identify an empty space 40 which is directly between the end portions 8, 8. This space is important to ensure that the hanger arms 6 extend above the eyeglasses when the temple bars of the eyeglasses are inserted through the openings 10, 10. Thus, a customer may try on the eyeglasses with the hanger attached and be able to look into a mirror without having the hanger be in front of the eyeglasses at any location. An unobstructed view of the eyeglasses is therefore obtained. Further, the hanger has no portion thereof behind the eyeglass frame bridge in the vicinity of the nose of the customer.

Figure 4:
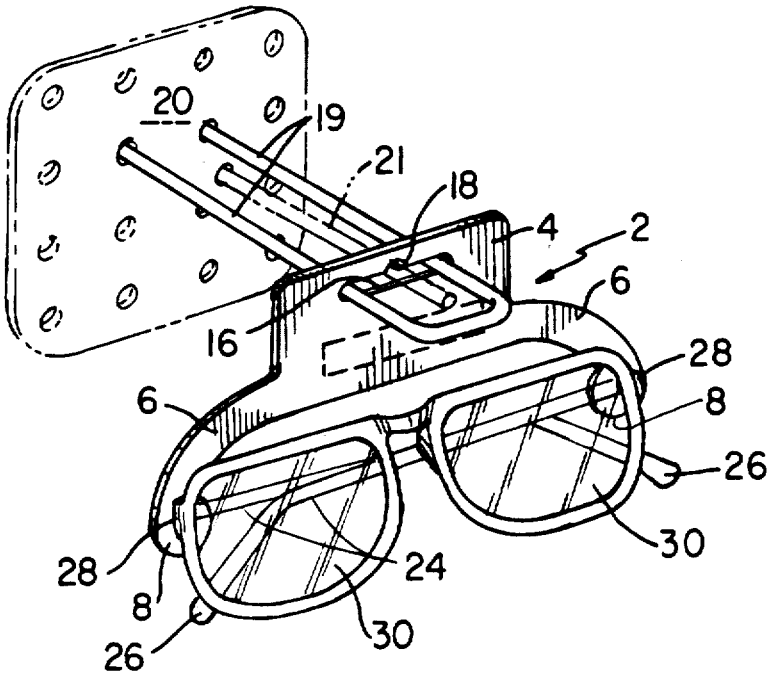
FIG. 4 is a perspective front view of the hanger of FIG. 3 in use for supporting a pair of eyeglasses to hang from a support arm.
Figure 5:
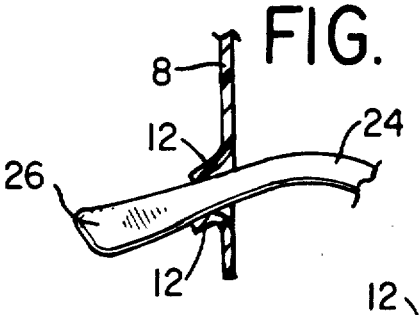
FIG. 5 is a cross-section of a thicker end of a temple bar being inserted through the end of the hanger of the second embodiment taken across section lines 5—5 of FIG. 2.

The arms 6 of the hanger 2 may have a lower edge 14 which is curved as shown, but the amount of such curvature may vary depending upon the location of the pivot lugs to the side of the eyeglasses (compare FIGS. 1 and 2). The central portion 4 has an aperture 16 whose shape is well known and is, for example shown as aperture 16 with notch 18 in FIG. 3 of U.S. Pat. No. 4,976,532 for insertion of a cantilevered support 19, which extends from a base 20 as shown in FIG. 4. A support arm 21 may be inserted through the notch 18.

Figure 6:
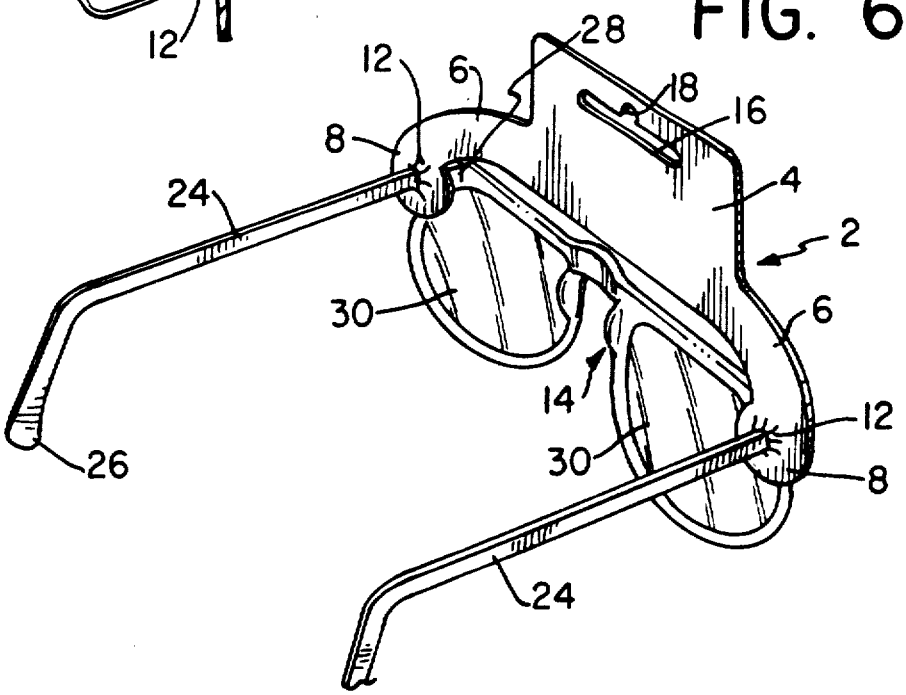
FIG. 6 is a perspective rear view of the hanger secured to a pair of eyeglasses.

FIGS. 4 and 6 shows the hanger supporting a conventional pair of eyeglasses 22. The pair of eyeglasses has temple bars 24 with thickened ends 26 and has pivot lugs 28 which are to the side of the eyeglasses 30 themselves and which allow the temple bars 24 to pivot about them with respect to the eyeglasses 30.

The ends 26 of the temple bars 24 are inserted through the circular openings 10, taking advantage of the enlarged opening afforded by the slits 12 as needed (See FIG. 3). The temple bars 24 are further inserted until the circular apertures are essentially adjacent to the lugs 28 of the pair of eyeglasses 22. As the temple bars narrow away from the ends 26, the slits 12 close together resiliently in response to the narrower cross-section to provide a friction grip on the temple bars. This helps prevent casual removal of the hanger from the eyeglasses.

In this position, the support arm 19 of a display 20 may be inserted through the aperture 16 in the central portion 4 of the hanger 2. Aperture 16 is substantially equidistant from the circular openings 10 in the end portions 8 so that the pair of eyeglasses 22 hangs balanced from the support arm 19.

As seen in FIG. 2, the central portion 4 of the hanger 2 is at an elevation which is higher than the pair of eyeglasses 22. In this manner, the hanger carrying the eyeglasses 22 may be readily slid off the support arm 19 and the glasses tried on by the customer directly, without the need for removing the hanger 2. Further, the hanger will not contact the face of the customer trying on the pair of eyeglasses at any location where the frame of the eyeglasses is normally in contact with the face during normal wear. Thus, the customer may get a realistic feel of the eyeglass frame when wearing it even with the hanger still secured to the temple bars.

In addition, extending the central portion of the hanger at this higher elevation has the added advantage of not covering any portion of the front of the eyeglasses which the customer sees when looking at eyeglasses hanging from the support arm. Thus, the customer gets a true sense of the look of the eyeglass as it hangs on the support arm. Further, when the customer tries on the pair of eyeglasses with the hanger still attached thereto, the customer may look at a mirror and have an unobstructed view of how the eyeglasses appear on the face wile wearing them because the hanger will not be covering up any part of the front of the eyeglasses. The hanger is preferably transparent so as to not distract the attention of the customer from the appearance of the eyeglasses when worn with the hanger still attached.

As mentioned previously, the curvature of the central portion 6 of the hanger depends on the shape of the particular pair of eyeglasses, specifically the relative position of the lugs 28 on the frame of the eyeglasses 30. The degree of curvature is such that the central portion extends at an elevation which is higher than that of the eyeglasses 30 as they hang from the support arm 19. If the pivot lugs are positioned at a location which is nearer to the lower part of the eyeglass frame, the optimum curvature of the hanger is greater, such as shown in FIG. 2. Thus, whether the attachment location of the lugs 28 is at an elevation within the upper, middle or lower third of the height of the pair of eyeglasses, a hanger may be selected with an appropriate curvature of the arms to completely clear the top of the rim of the lenses of the pair of eyeglasses when the temple bars are inserted through openings in the end portions of the hangers.

Of course, the central portion may take on any shape or have no curvature at all; it is desired to have the hanger extend at a higher elevation than the eyeglasses. If desired, the central portion 4 may extend by a height so as to accommodate placement of an advertisement 32 thereon as shown in FIG. 2.

Although the aperture 16 with notch 18 is configured to accommodate a specific type of support arm 19, the aperture may instead take on any shape which conforms in shape for effecting engagement with another type of support arm which may be configured differently. However, such an aperture should preferably still be equidistant from the other openings 10 so as to ensure balancing of the pair of eyeglasses being held by the hanger on the support arm.

What is claimed is:

1. A hanger for suspending from a support arm, a pair of eyeglasses which have two lenses and two temple bars, the hanger comprising:

a substantially flat planar element having a central portion comprising means for receiving the support arm therein and having two arms which extend away from said central portion and which terminate at respective end portions, said arms and said central portion defining a common plane, said end portions each having a respective opening adapted to receive a respective one of the temple bars of the pair of eyeglasses, said central portion having a lowermost edge at an elevation higher than that of said respective openings so that an empty space is defined at the same elevation as the openings and extending directly between said end portions and up to said lower edge within said common plane, said means for receiving the support arm being substantially equidistant from said openings for balancing the pair of eyeglasses so that said two arms each extend above the lenses of the pair of eyeglasses when the temple bars are inserted through said openings and the support arm is inserted into said means, whereby when the temple bars are received in the openings and the hanger balances the pair of eyeglasses with respect to the support arm, said empty space allows substantially unobstructed vision through the lenses of the pair of eyeglasses.

2. A hanger as in claim 1, wherein said central portion and said arms are made of a transparent material.

3. A hanger as in claim 1, wherein said central portion and said arms are made of a resilient flexible material which is bendable in a direction out of said common plane.

4. A hanger as in claim 1, wherein said arms and said central portion are arranged with respect to said end portions so that a top edge of a rim of the lenses of the pair of eyeglasses appears to be in front of the empty space and completely cleared by said arms and said central portion when viewing from in front of the lenses after insertion of the temple bars of the pair of eyeglasses through said openings.

5. A hanger as in claim 1, wherein said openings are slits.

6. A hanger as in claim 1, in combination with a pair of eyeglasses which has two temple bars, each of said temple bars extending through a respective one of said openings so that said two arms and said central portion each extend above a rim of the lenses of the pair of eyeglasses when the support arm is inserted into said aperture.

7. A hanger as in claim 1, wherein said end portions each have at least one slit which extends radially outward from a respective one of said openings so as to accommodate insertion of a portion of one of the temple bars which is larger in cross-section than said one opening.

8. A hanger as in claim 7, wherein said end portions each have a plurality of slits and have radial projections forming areas which are between said slits, said projections resiliently bending in response to the insertion of the portion of the temple bar which is larger in cross-section than said one opening.

9. A hanger as in claim 1, wherein said end portions each have at least a pair of slits which extend diametrically opposite each other from a respective one of said openings.

10. A hanger as in claim 1, wherein one of said end portions has a first plurality of slits extending radially outwardly from one of said openings, the other of said end portions having a second plurality of slits extending radially outwardly from the other of said openings, said end portions being resiliently bendable between each of said slits.

11. A hanger as in claim 1, wherein said central portion has an advertisement.

12. A hanger as in claim 1, in combination with a pair of eyeglasses which has two temple bars, each of said temple bars extending through a respective one of said openings so that said two arms and said central portion each extend above a rim of the lenses of the pair of eyeglasses when the support arm is inserted into said aperture.

13. A combination as in claim 12, wherein said arms are configured such that a lower edge of said arms and said central portion appears to completely clear a top edge of a frame of the lenses of the pair of eyeglasses when viewed from the front of the pair of eyeglasses, the lenses being in front of the empty space.

14. A combination as in claim 13, wherein the pair of eyeglasses has an attachment location of the pivot lugs located at an elevation within a lower third of the height of the pair of eyeglasses as viewed from the front, the lower edge having a relatively small radius of curvature than would otherwise be necessary for clearing the lenses if the lugs were located higher.

15. A combination as in claim 13, wherein the pair of eyeglasses has an attachment location of the pivot lugs located at an elevation within a middle-third of the height of the pair of eyeglasses as viewed from the front, the lower edge having a radius of curvature which is smaller than would otherwise be necessary to clear the lenses if the lugs were located higher and which is larger than would otherwise be necessary to clear the lenses if the lugs were located lower.

16. A combination as in claim 13, wherein the pair of eyeglasses has an attachment location of the pivot bars located at an elevation within an upper third of the height of the pair of eyeglasses as viewed from the front, the lower edge having a relatively larger radius of curvature than would otherwise be necessary for clearing the lenses if the lugs were located lower.

17. A combination as in claim 12, wherein said central portion is arranged to completely clear a nose bridge frame of the eyeglasses that is between the lenses of the eyeglasses.

18. A hanger as in claim 1, wherein the means for receiving the support arm comprises a further opening into which may be inserted the support arm.

19. A hanger for suspending from a support arm, a pair of eyeglasses which have two temple bars, comprising:

a substantially flat planar element having a central portion with an aperture adapted for receiving insertion of the support arm therethrough and having two arms which extend away from said central portion and which terminate at respective end portions, said arms and said central portion each having a face which defines a common plane, said central portion being at an elevation higher than that of said end portions so as to define an empty space directly between said end portions within said common plane, said central portion and said two arms being stiff to resist against bending along said common plane, said end portions each having a respective opening adapted for receiving insertion therethrough of a respective one of the temple bars of the pair of eyeglasses, said aperture being substantially equidistant from said openings for balancing the pair of eyeglasses so that said two arms and said central portion each extend above a rim of the lenses of the pair of eyeglasses when the temple bars are inserted through said openings and the support arm is inserted into said aperture, said end portions each having at least one slit which extends radially outward from a respective one of said openings so as to accommodate insertion of a portion of one of the temple bars which is larger in cross-section than said one opening, whereby the hanger extends entirely from behind rather than in front of the pair of eyeglasses when the temple bars are inserted through the openings and the hanger balances the pair of eyeglasses with respect to the support arm.

20. A hanger as in claim 19, wherein said end portions each have a plurality of slits and have radial projections forming areas which are between said slits, said projections resiliently bending in response to the insertion of the portion of the temple bar which is larger in cross-section than said one opening.

21. A hanger for suspending from a support arm, a pair of eyeglasses which have two temple bars, comprising:

a substantially flat planar element having a central portion with an aperture adapted for receiving insertion of the support arm therethrough and having two arms which extend away from said central portion and which terminate at respective end portions, said arms and said central portion each having a face which defines a common plane, said central portion being at an elevation higher than that of said end portions so as to define an empty space directly between said end portions within said common plane, said central portion and said two arms being stiff to resist against bending along said common plane, said end portions each having a respective opening adapted for receiving insertion therethrough of a respective one of the temple bars of the pair of eyeglasses, said aperture being substantially equidistant from said openings for balancing the pair of eyeglasses so that said two arms and said central portion each extend above a rim of the lenses of the pair of eyeglasses when the temple bars are inserted through said openings and the support arm is inserted into said aperture, said end portions each having at least a pair of slits which extend diametrically opposite each other from a respective one of said openings, whereby the hanger extends entirely from behind rather than in front of the pair of eyeglasses when the temple bars are inserted through the openings and the hanger balances the pair of eyeglasses with respect to the support arm.

22. A hanger for suspending from a support arm, a pair of eyeglasses which have two temple bars, comprising:

a substantially flat planar element having a central portion with an aperture adapted for receiving insertion of the support arm therethrough and having two arms which extend away from said central portion and which terminate at respective end portions, said arms and said central portion each having a face which defines a common plane, said central portion being at an elevation higher than that of said end portions so as to define an empty space directly between said end portions within said common plane, said central portion and said two arms being stiff to resist against bending along said common plane, said end portions each having a respective opening adapted for receiving insertion therethrough of a respective one of the temple bars of the pair of eyeglasses, said aperture being substantially equidistant from said openings for balancing the pair of eyeglasses so that said two arms and said central portion each extend above a rim of the lenses of the pair of eyeglasses when the temple bars are inserted through said openings and the support arm is inserted into said aperture, one of said end portions having a first plurality of slits extending radially outward from a respective one of said openings, the other of said end portions having a second plurality of slits extending radially outward from the other of said openings, said end portions being resiliently bendable between each of said slits, whereby the hanger extends entirely from behind rather than in front of the pair of eyeglasses when the temple bars are inserted through the openings and the hanger balances the pair of eyeglasses with respect to the support arm.

23. A hanger for suspending from a support arm, a pair of eyeglasses which have two temple bars, comprising:

a substantially flat planar element having a central portion with an aperture adapted for receiving insertion of the support arm therethrough and having two arms which extend away from said central portion and which terminate at respective end portions, said arms and said central portion each having a face which defines a common plane, said central portion being at an elevation higher than that of said end portions so as to define an empty space directly between said end portions within said common plane, said central portion and said two arms being stiff to resist against bending along said common plane, said end portions each having a respective opening adapted for receiving insertion therethrough of a respective one of the temple bars of the pair of eyeglasses, said aperture being substantially equidistant from said openings for balancing the pair of eyeglasses so that said two arms and said central portion each extend above a rim of the lenses of the pair of eyeglasses when the temple bars are inserted through said openings and the support arm is inserted into said aperture, said central portion having an advertisement, whereby the hanger extends entirely from behind rather than in front of the pair of eyeglasses when the temple bars are inserted through the openings and the hanger balances the pair of eyeglasses with respect to the support arm.

24. A combination of a pair of eyeglasses which have two temple bars and a hanger for suspending the pair of eyeglasses from a support arm, the combination comprising:

a substantially flat planar element as the hanger, the planar element having a central portion with an aperture adapted for receiving insertion of the support arm therethrough and having two arms which extend away from said central portion and which terminate at respective end portions, said arms and said central portion each having a face which defines a common plane, said central portion being at an elevation higher than that of said end portions so as to define an empty space directly between said end portions within said common plane, said central portion and said two arms being stiff to resist against bending along said common plane, said end portions each having a respective opening adapted for receiving insertion therethrough of a respective one of the temple bars of the pair of eyeglasses, said aperture being substantially equidistant from said openings for balancing the pair of eyeglasses so that said two arms and said central portion each extend above a rim of the lenses of the pair of eyeglasses when the temple bars are inserted through said openings and the support arm is inserted into said aperture, each of said temple bars extending through a respective one of said openings, said arms extending so that a lower edge of said arms and said central portion appears to completely clear a top edge of a frame of the lenses of the pair of eyeglasses when viewed from the front of the pair of eyeglasses, the lenses being in front of the empty space, whereby the hanger extends entirely from behind rather than in front of the pair of eyeglasses when the temple bars are inserted through the openings and the hanger balances the pair of eyeglasses with respect to the support arm.

25. A combination as in claim 24, wherein the pair of eyeglasses has an attachment location of the pivot lugs located at an elevation within a lower third of the height of the pair of eyeglasses as viewed from the front, the lower edge having a relatively small radius of curvature than would otherwise be necessary for clearing the lenses if the lugs were located higher.

26. A combination as in claim 24, wherein the pair of eyeglasses has an attachment location of the pivot lugs located at an elevation within a middle third of the height of the pair of eyeglasses as viewed from the front, the lower edge having a radius of curvature which is smaller than would otherwise be necessary to clear the lenses if the lugs were located higher and which is larger than would otherwise be necessary to clear the lenses if the lugs were located lower.

27. A combination as in claim 24, wherein the pair of eyeglasses has an attachment location of the pivot bars located at an elevation within an upper third of the height of the pair of eyeglasses as viewed from the front, the lower edge having a relatively large radius of curvature than would otherwise be necessary for clearing the lenses if the lugs were located lower.

28. A combination of a pair of eyeglasses which have two temple bars and a hanger for suspending the pair of eyeglasses from a support arm, the combination comprising:

a substantially flat planar element as the hanger, the planar element having a central portion with an aperture adapted for receiving insertion of the support arm therethrough and having two arms which extend away from said central portion and which terminate at respective end portions, said arms and said central portion each having a face which defines a common plane, said central portion being at an elevation higher than that of said end portions so as to define an empty space directly between said end portions within said common plane, said central portion and said two arms being stiff to resist against bending along said common plane, said end portions each having a respective opening adapted for receiving insertion therethrough of a respective one of the temple bars of the pair of eyeglasses, said aperture being substantially equidistant from said openings for balancing the pair of eyeglasses so that said two arms and said central portion each extend above a rim of the lenses of the pair of eyeglasses when the temple bars are inserted through said openings and the support arm is inserted into said aperture, said central portion being arranged to completely clear a nose bridge frame of the eyeglasses that is between the lenses of the eyeglasses, whereby the hanger extends entirely from behind rather than in front of the pair of eyeglasses when the temple bars are inserted through the openings and the hanger balances the pair of eyeglasses with respect to the support arm.

29. A hanger for suspending from a support arm, a pair of eyeglasses which have two lenses and two temple bars, the hanger comprising:

a substantially flat planar element having a central portion comprising means for receiving the support arm therein and having two arms which extend away from said central portion and which terminate at respective end portions, said arms and said central portion defining a common plane, said end portions each having a respective opening adapted to receive a respective one of the temple bars of the pair of eyeglasses, each of said arms having a length and a measured portion of such length having a lower edge at an elevation higher than that of said respective openings so that an empty space is defined at the same elevation as the openings and extending directly between said end portions and up to said lower edges within said common plane, said means for receiving the support arm being substantially equidistant from said openings for balancing the pair of eyeglasses so that said two arms each extend above the lenses of the pair of eyeglasses when the temple bars are inserted through said openings and the support arm is inserted into said means, whereby when the temple bars are received in the openings and the hanger balances the pair of eyeglasses with respect to the support arm, said empty space allows substantially unobstructed vision through the lenses of the pair of eyeglasses.

* * * * *